United States Patent [19]

Caughey

[11] 4,307,673

[45] Dec. 29, 1981

[54] SPARK ARRESTING MODULE

[75] Inventor: Robert A. Caughey, Antrim, N.H.

[73] Assignee: Forest Fuels, Inc., Marlborough, N.H.

[21] Appl. No.: 59,907

[22] Filed: Jul. 23, 1979

[51] Int. Cl.[3] ..... F23J 15/00

[52] U.S. Cl. ..... 110/119; 55/297; 55/401

[58] Field of Search ..... 110/119, 121, 122, 125; 55/296, 297, 401, 406; 432/72; 241/88.4; 126/181

[56] References Cited

U.S. PATENT DOCUMENTS

| | | | |
|---|---|---|---|
| 392,492 | 11/1888 | Bracher | 241/88.4 X |
| 1,071,369 | 8/1913 | Terry | 110/122 |
| 3,907,215 | 9/1975 | Mantelet | 241/88.4 |

FOREIGN PATENT DOCUMENTS

| | | | |
|---|---|---|---|
| 1815279 | 7/1970 | Fed. Rep. of Germany | 55/406 |
| 4491 | of 1915 | United Kingdom | 110/122 |

*Primary Examiner*—Albert J. Makay
*Assistant Examiner*—Harold Joyce
*Attorney, Agent, or Firm*—Robert T. Gammons

[57] ABSTRACT

A spark-arresting module for disposition in a duct for hot stack gases comprising a rigid frame structured with spaced, parallel bars alternating with spaced, parallel slots, a shaft at the upstream side of the frame and parallel thereto, a plurality of blades provided with diametrically-located vanes fixed to the shaft for rotation therewith, said vanes being movable through the slots in shearing relation to the bars by rotation of the shaft and being so shaped that some portion of each blade is at all times situated between the bars and a motor for effecting rotation of the shaft.

6 Claims, 7 Drawing Figures

SPARK ARRESTING MODULE

BACKGROUND OF THE INVENTION

The invention relates to a spark barrier designed to eliminate sparks from boiler stack gases in order that hot gases may be directly emitted to a dryer containing combustible material. In the past, there has been a considerable amount of difficulty experienced in the operation of direct fired dry kilns because spark carry-over has developed fires, often destroying an entire dry kiln.

Since present day dry kilns operate at a temperature well over 200° F., a relatively small spark, if it lands on the hot surface of a board in the kiln, can start a fire. If, however, the spark is limited to a very small size, it will either burn out during transportation to the kiln or will not be of sufficient size to generate enough heat to start a fire. It is the purpose of this invention to provide a spark screen which will intercept and crush sparks of such size as to cause a fire.

SUMMARY OF THE INVENTION

As herein illustrated, the spark barrier is designed to be interposed in a conductor of stack gases, for example, a conductor through which the hot gases are led to a dryer and comprises spaced, parallel bars alternating with spaced, parallel slots and blades corresponding in a number to the slots supported for rotation in the slots so that the blades alternately enter and leave the slots and wherein the blades are of such shape that at least some portion of each blade always projects into the slots between the blades. The slots and blades are dimensioned such that the vanes of the blades have shearing relation with the sides of the bars defining the slots and the vanes of adjacent blades are situated at right angles to each other. The spark barrier is desirably no more than approximately 6 inches by 6 inches and one or more modules are mounted in a suitable frame in transverse rows and in vertical banks across the entire cross-sectional area of the duct, depending upon the cross section of the duct. Vertically-spaced, parallel shafts, one for each of the rows of modules, are provided to which the blades are fixed for rotation and there is means for effecting rotation of all of the shafts from a common drive motor. The blades are preferably approximately 0.024 inches in width and spaced apart 0.036 inches and the vanes of the blades are approximately 0.024 inches thick.

The invention will now be described in greater detail with reference to the accompanying drawings, wherein.

In the burning of biomass materials such as wood chips, sawdust, shavings, or agricultural wastes such as straw or corn cobs, one of the serious problems encountered is the entrainment of live sparks in the stack gas as it is discharged from the furnace or combustion chamber. This entrainment of live sparks is particularly important where the stack gases may be employed for the direct heating of such apparatus as dry kilns, fuel dryers, etc.

It has been found that the objectionable sparks can be removed from the gas stream by the use of a screen having suitably fine openings. The size of the opening must be such that any minute spark passing the screen will have such a short burning life that it can do no incendiary damage in the device being heated. Usually a screen opening smaller than 1/16" will adequately limit spark size.

The principal problem in the use of a typical wire mesh screen for this purpose lies in the fact that it must be continuously cleaned to avoid undesirable reduction in gas flow. The cleaning of the screen must also be accomplished in such a way as to virtually eliminate a failure of the screen which might result in leakage of sparks downstream.

Centrifugal spark separtion may be used, but do not provide positive limitation of spark size, and therefore are not infallible. They also require considerable energy for operation.

The subject device has been developed to provide the following advantages:

1. To limit the passage of sparks.
2. Provide a durable structure.
3. Make possible a continuous cleaning with minimal danger of mechanical failure while retaining maximum flow characteristics.

The self-cleaning spark screen as shown herein consists of two principal components: First, a grid of metal plates having a controlled spacing between the plates and, second, a rotor consisting of shaft-mounted vanes which may be interleaved between the screen plate and rotated to:

A. keep the spaces between the screen plates clean and open;

B. maintain spacing between the screen plates; and

C. crush any airborne embers impinging on the grid to a size not troublesome in emerging gas stream.

Figure 1:
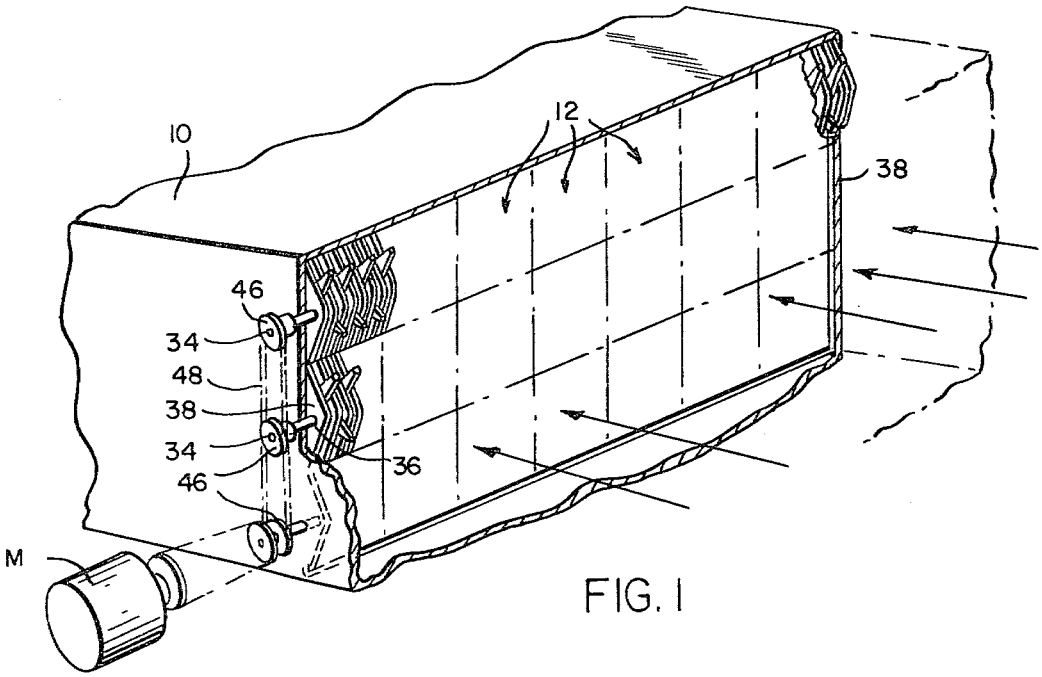
FIG. 1 is an isometric of a duct provided with transversely and vertically-disposed spark barrier modules.
Figure 2:
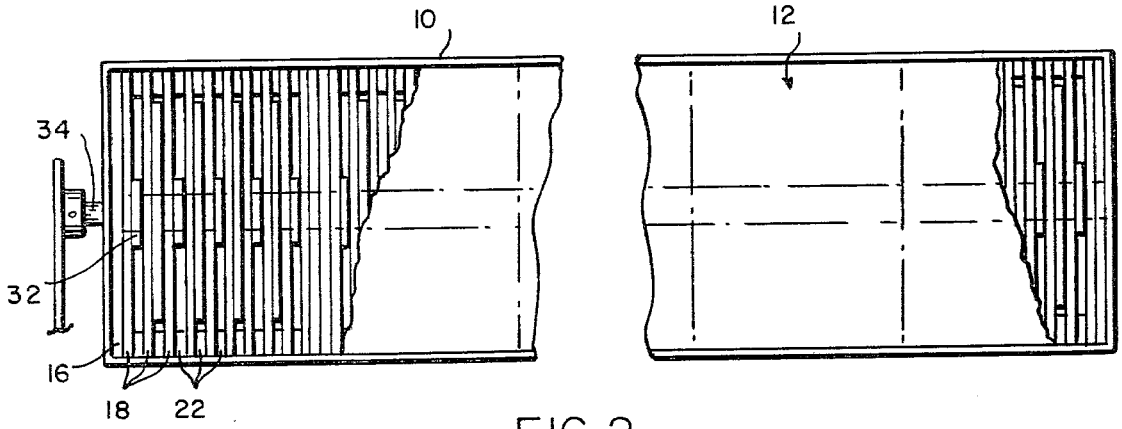
FIG. 2 is a front elevation of a single transverse row of modules for a duct of no more than single module depth.
Figure 3:
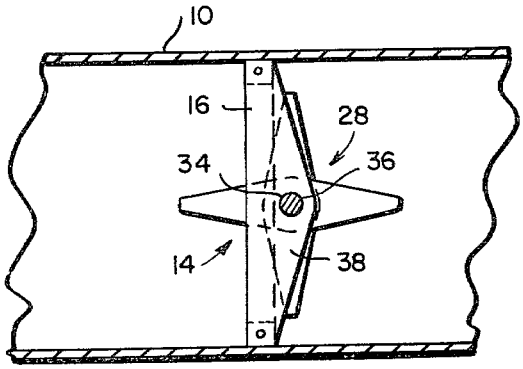
FIG. 3 is a fragmentary elevation as seen from one side of the duct shown in FIG. 2.
Figure 4:
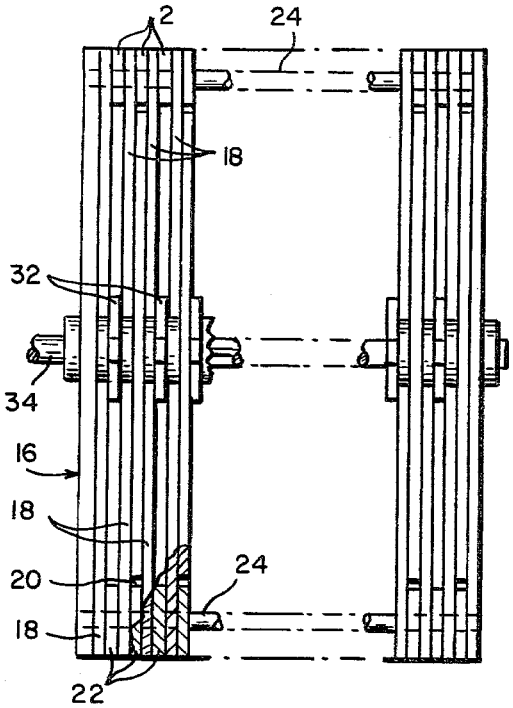
FIG. 4 is an enlarged elevation of a single module comprising a spark screen and blades.

Referring to the drawings, FIGS. 1 and 2, there are shown stack gas conductors 10, each of which is provided with a plurality of spark-arresting modules 12. In FIG. 1, there are three banks of transversely-disposed modules and in FIG. 2, a single bank of transversely-disposed modules. The number of banks of modules and the number of modules in a transverse row will depend upon the dimensions of the duct. Each module, FIGS. 4 and 5, comprises a screen assembly 14 and a blade assembly 28.

The screen assembly 14 comprised spaced, parallel outer bars 16—16 defining its transverse dimension and between these bars 16—16, spaced, parallel bars 18 alternating with spaced, parallel slots 20. There are spacers 22 between the bars 18 and the structure comprising the outer bars 16—16 and intermediate bars 18 are rigidly connected by transverse rods 24. Desirably, the effective area of the screen assembly is approximately no more than 6 inches by 6 inches. The bars are made of 24 gage (0.024) sheet metal and the spacers are made of 20 gage (0.36) sheet metal.

Figure 5:
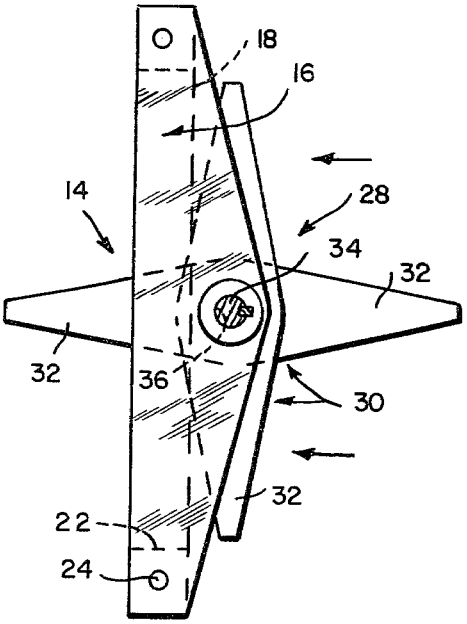
FIG. 5 is an end elevation of FIG. 4.
Figure 6:
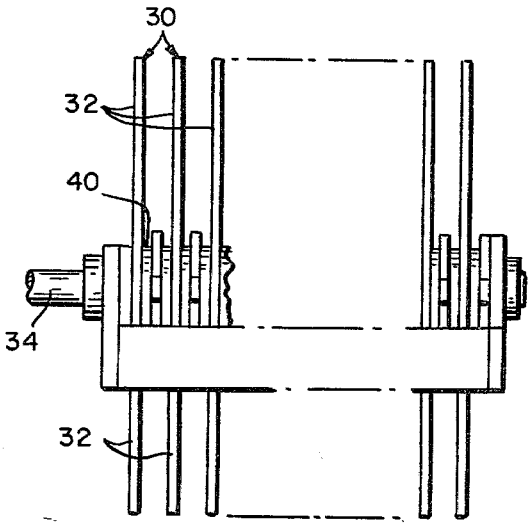
FIG. 6 is an elevation of the blade assembly.

The blade assembly 28, FIG. 6, comprises a plurality of blades 30, each of which has a diametrically-arranged vanes 32—32 of truncated configuration as shown in FIG. 5. Adjacent blades 30 are fixed to a horizontally-disposed shaft 34 journaled at its opposite ends in suitable bearings 36—36, FIG. 1, in bearing plates 38—38 at the upstream side of the outer bars 16—16 and at a distance from the upstream side of the screen assembly such that rotation of the shaft 34 will move the vanes through the slots 20 in shearing relation with the bars 18. The vanes 32 of the blades are constructed of 24 gage (0.024) sheet metal and are mounted on the shaft 34 in spaced relation by spacers 40 which are of 20 gage thickness (0.036). The radii of the blades at their centers are greater than the distance between the axis of rotation of the shaft 34 and the face of the screen so that, as shown in FIG. 5, at least a portion of each blade is at all times situated between adjacent bars. Adjacent blades are mounted to the shaft 34 at right angles to each other. The blades are keyed to the shaft 34 in spaced, parallel relation with the spacers 40 interposed between the blades. The spacers are of 20 gage metal (0.036) inches and the blades are 24 gage metal (0.024) inches.

The difference between the blade thickness and the spacer thickness is such as to allow freedom of movement of the blades between the bars of the screen without significant wear. The orientation of the alternate vanes of the blade assembly permits continuous rotation and cleaning action without significant change in pressure drop across the duct so that uniform gas flow can be maintained.

Figure 7:
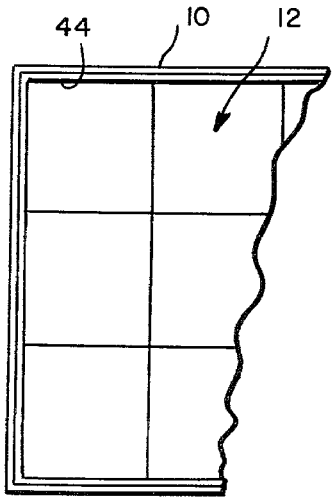
FIG. 7 is a fragmentary elevation of a spark-tight frame for mounting a plurality of modules in a duct.

Because the device is intended to operate at temperatures as high as 500° F. to 600° F., the size of the individual modules, as previously related, is limited both as to the length of the bars of the screen assembly and the and the length of the blade assembly so that any differential temperature will not cause significant changes in the spacing between the bars or binding between the rotary vanes and the bars. As a practical matter, the size of the screen modules should have an active screening area of approximately 6 inches by 6 inches. Accordingly, to provide for large flow capacity, a plurality of modules are assembled in a suitable spark-tight frame 44, FIG. 7, corresponding in cross section to the duct and the frame together with an assembly of modules inserted into the duct.

Sprockets 46 are fixed to the ends of the respective shafts 34 and a chain 48 is entrained about the several sprockets so that by rotating one shaft, all of the shafts may be correspondingly rotated. As herein illustrated, a motor M is provided for rotating the lower one of the shafts shown in FIG. 1.

The speed of rotation of the blade assembly is generally very slow, in the order of 2 to 5 rpm, so that the drive power and mechanical wear may be expected to be very low.

Installation of such a spark arrester in a duct will, of course, tend to restrict flow. Therefore, the duct cross section should be enlarged to provide a screen face area considerably larger than the normal cross-sectional area of the duct so that the pressure drop across the screen will be excessive.

It should be understood that the present disclosure is for the purpose of illustration only and includes all modifications or improvements which fall within the scope of the appended claims.

I claim:

1. In a duct for conducting stack gases, a spark barrier comprising a rigid frame, transversely-spaced bars having broad and narrow sides positioned in the frame with the broad sides spaced apart in parallel relation and defining narrow spaces between the broad sides corresponding in width to the width of the narrow side and with the narrow sides at both front and back of the frame lying in planes perpendicular to the front and back sides, said frame when supported in a duct as a barrier presenting the narrow sides of the bars at right angles to the direction of flow of the gases through the duct and the broad sides parallel to the direction of flow of the gases through the duct, a shaft, means supporting the shaft in a position parallel to the plane containing the narrow sides of the bars at the front upstream side of the frame and at right angles to the longitudinal dimensions of the bars and spaced therefrom at the upstream side, a plurality of blades corresponding in number to the number of the spaces between bars fixed to the shaft with adjacent blades angularly displaced at right angles to each other, each blade comprising base-to-base trapezoidal vanes extending radially from the axis of the shaft, one-half of the base of said vanes being greater than the distance between the axis of the shaft and the plane in which lie the narrow sides of the bars at the front side so that portions of the blades are always located between the bars at the front side and means for effecting rotation of the shaft.

2. In a duct for conducting stack gases, a rigid, spark-tight frame mounted in the duct in a plane perpendicular to the flow path through the duct and at least one row of spark-arresting modules according to claim 1 assembled in the frame transversely of the flow path, said modules being no more than approximately 6 inches by 6 inches in effective area.

3. In a duct, a plurality of spark-arresting modules according to claim 1 positioned in a row transversely of the duct and in a bank vertically of the duct.

4. Apparatus according to claim 1 wherein the blades are 0.024 inches in width and spaced apart 0.03 inches.

5. Apparatus according to claim 1 wherein the vanes of the blades are 0.024 inches in width.

6. Apparatus according to claim 1 wherein the effective area of the spark screen is not more than approximately 6 inches by 6 inches.

* * * * *